United States Patent [19]

Anfusio

[11] Patent Number: 4,519,365

[45] Date of Patent: May 28, 1985

[54] RECIPROCATING INTERNAL COMBUSTION ENGINE WITH MULTIPLE-VALVE CYLINDERS

[76] Inventor: Mario Anfusio, Via S. Matteo 23, Moncalieri (Torino), Italy

[21] Appl. No.: 581,017

[22] Filed: Feb. 17, 1984

[30] Foreign Application Priority Data

Feb. 24, 1983 [IT] Italy ..... 67207 A/83

[51] Int. Cl.[3] ..... F02B 15/00

[52] U.S. Cl. ..... 123/432; 123/315

[58] Field of Search ..... 123/430, 432, 315, 316, 123/308

[56] References Cited

U.S. PATENT DOCUMENTS

| | | | |
|---|---|---|---|
| 1,112,905 | 10/1914 | Heath | 123/315 |
| 1,168,879 | 1/1916 | Gass | 123/315 |
| 1,170,276 | 2/1916 | Kline | 123/315 |
| 1,934,238 | 11/1933 | Schimanek | 123/315 |
| 2,391,176 | 12/1945 | Mallory | 123/430 |
| 3,991,729 | 11/1976 | Notaro | 123/432 |
| 4,194,472 | 3/1980 | Amano et al. | 123/315 |
| 4,363,300 | 12/1982 | Honda | 123/315 |

*Primary Examiner*—E. Rollins Cross
*Attorney, Agent, or Firm*—Sughrue, Mion, Zinn, Macpeak, and Seas

[57] ABSTRACT

A reciprocating internal combustion engine has a head structure which includes a cylinder head and a separate inserted plate clamped between the cylinder head itself and the engine block. The combustion chamber of the or each cylinder is formed in the cylinder head in a position centered on the axis of the respective cylinder and the inserted plate has an aperture centered on the axis of the cylinder which puts the cylinder itself into communication with its combustion chamber. In correspondence with the or each cylinder, the inserted plate is formed with at least one first pair of opposing valve seats facing into the communication aperture, and corresponding inlet and/or exhaust ducts. These seats have associated mushroom valves with stems which extend through corresponding holes in the inserted plate and are slidable in the cylinder head. The cylinder head, in correspondence with the or each cylinder, is formed with at least one second pair of opposing valve seats facing into the combustion chamber, and corresponding inlet and/or exhaust ducts. These seats have associated mushroom valves with stems which are slidable in the cylinder head. The axes of the two pairs of valves are substantially coplanar. The crown of the or each piston has a projection of a form such as substantially to fill the respective communication aperture when the piston is at top dead-center.

2 Claims, 1 Drawing Figure

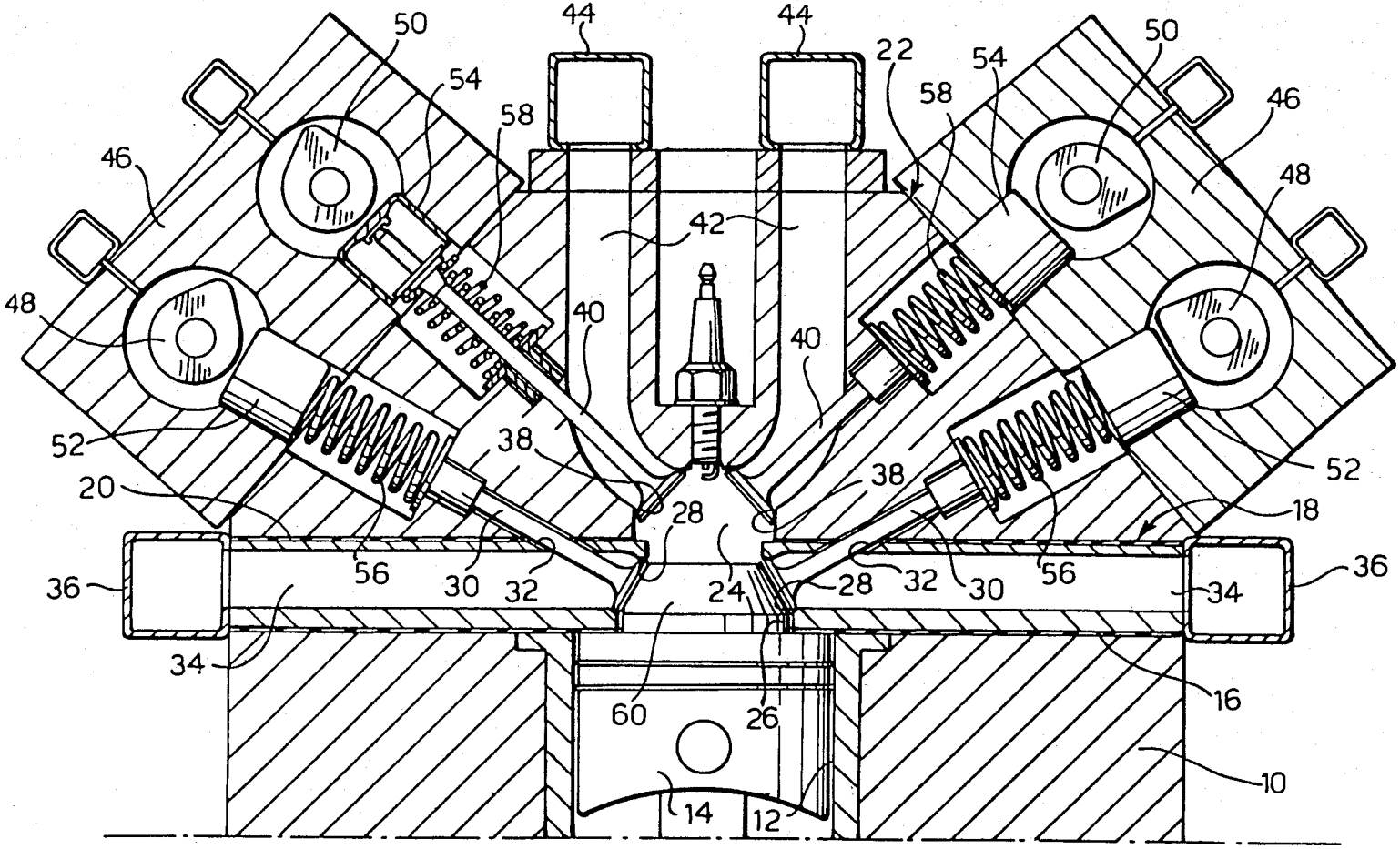
10
12
14
16
18
20
22
24
26
28
30
32
34
36
38
40
42
44
46
48
50
52
54
56
58
60

RECIPROCATING INTERNAL COMBUSTION ENGINE WITH MULTIPLE-VALVE CYLINDERS

The present invention relates to a reciprocating internal combustion engine of the type including an engine block with one or more cylinders in which or in each of which a piston is slidable, and a head structure which defines a combustion chamber in correspondence with the or each cylinder, and in which the or each combustion chamber has an associated pair of transversely opposed mushroom valves arranged in a V relative to the axis of the cylinder and having stems which are slidably mounted in the head structure, these valves cooperating with respective valve seats formed in the head structure facing the combustion chamber and at which terminate respective inlet and exhaust ducts formed in the head structure.

In order to improve the volumetric efficiency of a reciprocating internal combustion engine at high running rates, particularly for converting it into a competition engine, among other measures, one may have recourse to increasing the number of inlet and exhaust valves for each cylinder. For example, a cylinder head can be attached to the engine which has two pairs of valves arranged in a V and located side-by-side in pairs longitudinally of the engine. This solution, however, does not lend itself to application in engines which are very compact or have small cylinder capacities in which the cylinders are very close together. In such engines it is not in fact possible to use side-by-side valves of a desirably large diameter, since this would necessitate such an increase in the diameter of the combustion chambers as to make them interfere with the adjacent ones. Even the cylinder bores would have to be increased correspondingly, and this would be impossible to achieve due to the same problem of interference. The same problems may be found in the case of single-cylinder engines for motor cycles, where it is not possible to increase the diameter of the combustion chamber and the cylinder beyond certain limits.

The present invention aims to solve the problem of increasing the number of valves for the cylinders of internal combustion engines, without necessitating an increase in the diameter of the cylinders and the combustion chambers, while at the same time allowing relatively large-diameter valves to be used.

According to the present invention, this problem is solved by means of an internal combustion engine of the type mentioned at the beginning, characterised in that the head structure includes a cylinder head and a separate inserted plate clamped between the cylinder head itself and the engine block, in that the combustion chamber of the or each cylinder is formed in the cylinder head in a position centered on the axis of the cylinder and the inserted plate has an aperture centered on the axis of the cylinder which puts the cylinder itself into communication with the chamber, in that the inserted plate, in correspondence with the or each cylinder, is formed with at least one first pair of opposing valve seats facing the communication aperture and with corresponding inlet and/or exhaust ducts, these seats having associated mushroom valves with stems which extend through corresponding holes in the inserted plate and are slidable in the cylinder head, in that the cylinder head, in correspondence with the or each cylinder, is formed with at least one second pair of opposing valve seats facing into the combustion chamber and with corresponding inlet and/or exhaust ducts, these seats having associated mushroom valves with stems which are slidable in the cylinder head, the axes of the two pairs of valves being substantially coplanar, and in that the crown of the or each piston has a projection of a form such as substantially to fill the communication aperture when the piston is at to dead-centre.

By virtue of this solution, the pairs of valves are so to speak superposed rather than adjacent. It is thus possible to provide each cylinder with two pairs of superposed valves of large diameter and preferably with four pairs of superposed valves in adjacent pairs, having large overall inlet and exhaust duct sections, without this necessitating an increase in the diameter of the combustion chamber for receiving them.

The working (grinding, lapping, and polishing) of the valve seats formed in the inserted plate does not offer any difficulties since it is carried out with conventional tools, as in the case of a conventional cylinder head.

It is possible to dispose the "upper" valves in the cylinder head on axes with an optimum inclination such that the axial projection of the periphery of their mushroom heads and their seats intersect the edge of the communication aperture in the inserted plate. Under these conditions, if all the valves and their seats are located in a cylinder head formed in a single piece and having the same geometry as the cylinder head/inserted plate assembly according to the invention, it would be possible to work the seats and the "upper" valves only with the most expensive devices since it would not be possible to use front-working tools which advance axially. Even the assembly of the "upper" valves, if not impossible, would require extremely expensive apparatus.

The working of the valve seats in a cylinder head according to the invention, however, can be carried out with conventional tools, in the absence of the inserted plate, that is, in the absence of the edge of the communication aperture which, when the plate is present, at least partially masks these seats. The "upper" valves may also be fitted simply into their positions before coupling of the cylinder head and the inserted plate.

In an engine according to the invention, the increase in height of the combustion chamber due to the thickness of the inserted plate does not involve a reduction in the compression ratio because of the presence of the projection on the piston crown. Indeed, the compression ratio may be increased if desired by increasing the volume of the projection, particularly by increasing its height.

The invention will now be clarified by a reading of the detailed description which follows, made with reference to the single FIGURE of the appended drawings, which is a schematic cross-section of the upper part of an engine according to a preferred embodiment of the invention given purely by way of non-limiting example.

Throughout the description of the drawing, reference will be made to a single cylinder, combustion chamber, etc., it being understood that the engine illustrated and described may include any number of cylinders.

With reference to the drawing, the engine includes an engine block 10 with a cylinder 12 in which a piston 14 is slidable.

To the upper face of the block 10 is fitted, with the interposition of a gasket 16, an inserted plate 18, preferably of light alloy. The details of the inserted plate 18 will be described below.

A cylinder head, generally indicated 22, also preferably of light alloy, is fitted to the inserted plate 18 with the interposition of a gasket 20.

The head superstructure constituted by the cylinder head 22 and the inserted plate 18 is clamped onto the block 10 by means of the usual retaining screws (not shown) with which the block 10 is provided.

The cylinder head 22 is formed, in a position centered on the axis of the cylinder 12, with a combustion chamber 24.

The inserted plate 18 has an aperture 26 which is also centered on the axis of the cylinder 12 and puts the cylinder itself into communication with the combustion chamber 24. Preferably, the aperture 26 is substantially rectangular with dimensions slightly less than the diameter of the cylinder 12.

The inserted plate 16, in correspondence with the cylinder 12, is formed with opposing valve seats 28, which face the communication aperture 26.

The seats 28 have associated mushroom valves 30 disposed in a V. The stems of the valves 30 extend through inclined holes 32 in the inserted plate 18 and are slidable in the cylinder head 22.

Respective transverse ducts 34 formed in the inserted plate 18 terminate at one end at the valve seats 28 and at the other end at respective external manifolds 36.

In correspondence with the cylinder 12, the cylinder head 22 is formed with opposing valve seats 38 that face the combustion chamber 24. The seats 38 have respective associated mushroom valves 40 which are also disposed in a V and have stems slidable in the cylinder head 22.

Respective ducts 42 formed in the cylinder head 22 terminate at the valve seats 38 and communicate with respective manifolds 44.

To the cylinder head 22 is fixed a pair of lateral timing blocks 46 also preferably of light alloy. In each of these blocks is rotatably mounted a pair of camshafts the cams of which are indicated 48 and 50, respectively. The camshafts are driven by the engine shaft through a common timing chain (not shown).

The cams 48 control the valves 30 through cup tappets 52 and the cams 50 control the valves 40 through cup tappets 54.

Return springs for the valves 30 and the valves 40 are indicated 56 and 58 respectively.

Two pairs of valves, "lower" valves 30 and "upper" valves 40 respectively, may be associated with the cylinder 12. In this case, the axes of the four valves 30, 40 lie at least substantially in a transverse plane in which the axis of the cylinder 12 also lies.

Alternatively, a cylinder 12 may have two pairs of "lower" valves 30 and two pairs of "upper" valves 40 associated therewith. In this case, each pair of "lower" valves 30 and "upper" valves 40 lies substantially in a transverse plane symmetrical with respect to the axis of the cylinder 12 and to the planes in which the other two pairs of valves 30 and 40 lie.

Given the inclination of the mushroom heads of the lower valves 30, the aperture 26 is substantially frusto-conical. The crown of the piston 14 has a projection 60 cast therewith which has a substantially frusto-conical form complementary to that of the communication aperture 26.

As may be seen from the drawing, when the piston 14 is at top dead-centre, the projection 60 substantially fills the aperture 26. The purpose of the projection 60 is to define a volume of the combustion chamber 24 when the piston 14 is at top dead-centre such that the compression ratio is equal to or greater than what it would be in the absence of the inserted plate 18.

The choice between the valves 30 and 40, their respective ducts 34 and 42 and their respective manifolds 36 and 44 for the inlet function depends on the type of engine. For example, the pair or two pairs of lower valves 30 may be exhaust valves and the pair or two pairs of upper valves 40 may be inlet valves, or vice versa. Alternatively, one or two lower valves 30 may be arranged as inlets and the other or all the other lower valves 30 as exhausts. The same can be said for the upper valves 40.

In the drawing, the projection 60 appears to be in a position of interference with the mushrooms of the lower valves 30 when the piston 14 is at top dead-centre. This interference does not occur in practice, however, because the lower valves 30, whether they are inlet or exhaust valves, are closed when the piston 14 is at top dead-centre since, if they are inlet valves, they open with a certain delay after the beginning of the downward stroke of the piston 14 and, if they are exhaust valves, they are already closed for a certain period before the arrival of the piston 14 at top dead-centre.

I claim:

1. A reciprocating internal combustion engine of the type including an engine block defining at least one cylinder, a piston slidable in said at least one cylinder, a head structure which defines a combustion chamber in correspondence with said at least one cylinder, a pair of transversely opposed mushroom valves associated with the combustion chamber and disposed in a V relative to the axis of said at least one cylinder, said valves having stems slidably mounted in the head structure, respective seats for said valves formed in said head structure facing the combustion chamber, and inlet and exhaust ducts defined by the head structure terminating at said valve seats respectively, wherein the improvement comprises:

said head structure including a cylinder head and a separate inserted plate clamped between the cylinder head and said engine block;

said combustion chamber of said at least one cylinder being formed in said cylinder head in a position centered on the axis of the cylinder;

said inserted plate being formed with an aperture centered on the axis of said at least one cylinder which puts the cylinder into communication with the combustion chamber;

said inserted plate defining, in correspondence with said at least one cylinder, at least one first pair of opposing valve seats facing said communication aperture, said seats having respective associated mushroom valves with stems slidable in said cylinder head, first respective inlet/exhaust ducts terminating at the valve seats of said at least one first pair, and respective holes in which said valve stems are slidable;

said cylinder head defining, in correspondence with said at least one cylinder, at least one second pair of opposing valve seats facing into said combustion chamber, said seats having respective associated mushroom valves with stems slidable in said cylinder head, the axes of these valves being substantially coplanar with the axes of said valves of said at least one first pair of seats, and respective second inlet/exhaust ducts terminating at the valve seats of said at least one second pair, and said piston having on its crown a projection of a form adapted to substantially fill said communication aperture when the piston is at top dead-centre.

2. A reciprocating internal combustion engine as claimed in claim 1, wherein the axes of the valves of said second pair have an inclination such that the axial projection of the peripheries of their mushroom heads and their seats intersect the edge of the communication aperture in the inserted plate.

* * * * *